United States Patent [19]

Kuss et al.

[11] Patent Number: 4,625,654

[45] Date of Patent: Dec. 2, 1986

[54] COVER FOR COAL CAR

[76] Inventors: Thomas N. Kuss, P.O. Box 1750; Donald L. Horne, 4 Circle Dr., both of Prestonsburg, Ky. 41653

[21] Appl. No.: 751,860

[22] Filed: Jul. 5, 1985

[51] Int. Cl.[4] ..... B61D 39/00

[52] U.S. Cl. ..... 105/377; 296/100

[58] Field of Search ..... 105/377; 410/97-100, 410/101, 106, 108, 110; 224/329; 296/100; 24/68 CD, 129 R, 129 A, 300, 301; 220/315, 324; 248/499

[56] References Cited

U.S. PATENT DOCUMENTS

| | | | |
|---|---|---|---|
| 2,248,500 | 7/1941 | Hilbish et al. | 105/377 |
| 2,919,946 | 1/1960 | Miener | 296/100 |
| 2,969,284 | 1/1961 | Ambli | 296/100 |
| 3,044,653 | 7/1962 | Tantlinger | 296/100 |
| 3,330,225 | 7/1967 | Barry | 105/377 |
| 4,367,572 | 1/1983 | Zielenski | 410/97 |

FOREIGN PATENT DOCUMENTS

| | | | |
|---|---|---|---|
| 2231580 | 12/1974 | France | 296/100 |

*Primary Examiner*—Robert B. Reeves
*Assistant Examiner*—Dennis C. Rodgers
*Attorney, Agent, or Firm*—Frank P. Cyr

[57] ABSTRACT

A railway freight car adapted particularly for transporting coal or like granular materials where a flexible cover is adapted to be draped over the materials so as to protect them from the elements when the car is being transported from one place to another. In the transport of coal in particular, there are several problems presented if the coal is left uncovered during transport. First, there is the problem of coal dust particles flying in the surrounding atmosphere due to the aspiration of the coal dust during travel of the car especially when the car is travelling at a high rate of speed. Then of course, there is always the wind to be considered if the coal is left uncovered and here again you have coal dust particles being blown away from the coal and this dust is scattered into the surrounding atmosphere causing a pollution problem. Also, there is always the threat of the coal in the car being exposed to the elements such as rain or snow which will thus reduce the efficiency of the coal when the same is fed into a furnace for combustion therein. While the cover is particularly suitable for coal transporting cars, it is equally as effective to cover cars employed for transporting light weight granular materials such as grains or the like.

4 Claims, 10 Drawing Figures

COVER FOR COAL CAR

BACKGROUND OF THE INVENTION

Numerous attempts have been made in the past to provide a suitable cover for normally open top freight cars employed in the transporting of various granular materials such as coal, grains and the like. Such covers have been in the nature of hinged cover plates extending across the top of the car, the cover being constructed of wood, metal and various other type materials. In some instances a cover constructed of a fabric such as canvas has been utilized in this invironment but where a fabric cover has been employed in the past some problems have been presented particularly in providing a suitable means for securing the cover to the top of the car. Canvas covers have not proved to be desirable. The cost of canvas covers is prohibitive and often such covers are removed from the cars when the car reaches its destination and not returned to the shipper thus adding to the costs of shipping the materials in a car which has been provided with a canvas cover. Also, in the past, elaborate means have been devised to secure the cover to the sides and ends of the freight car thus adding to the costs of using a canvas cover for the car.

With the above in mind, it is one object of the invention to provide a simple yet efficient clamp means for securing a cover of sheet material to the top of a normally open topped freight car.

Another object of the invention is to provide a means whereby the cover of sheet material is caused to follow the contour of the materials within the car body thus insuring a constant contact of the cover with the materials in the car body.

Another object of the invention is to provide a means whereby the cover extending over the extension at the forward and rear portion of the car body will be securely fastened to the extension and thus avoiding an accidental removal of the cover at these portions of the freight car.

To the accomplishment of the above and subordinate objects presently appearing, a preferred embodiment of our invention has been illustrated in the accompanying drawings and set forth in detail in the succeeding description, and defined in the claims appended hereto.

DESCRIPTION OF THE PREFERRED EMBODIMENT

Figure 1:
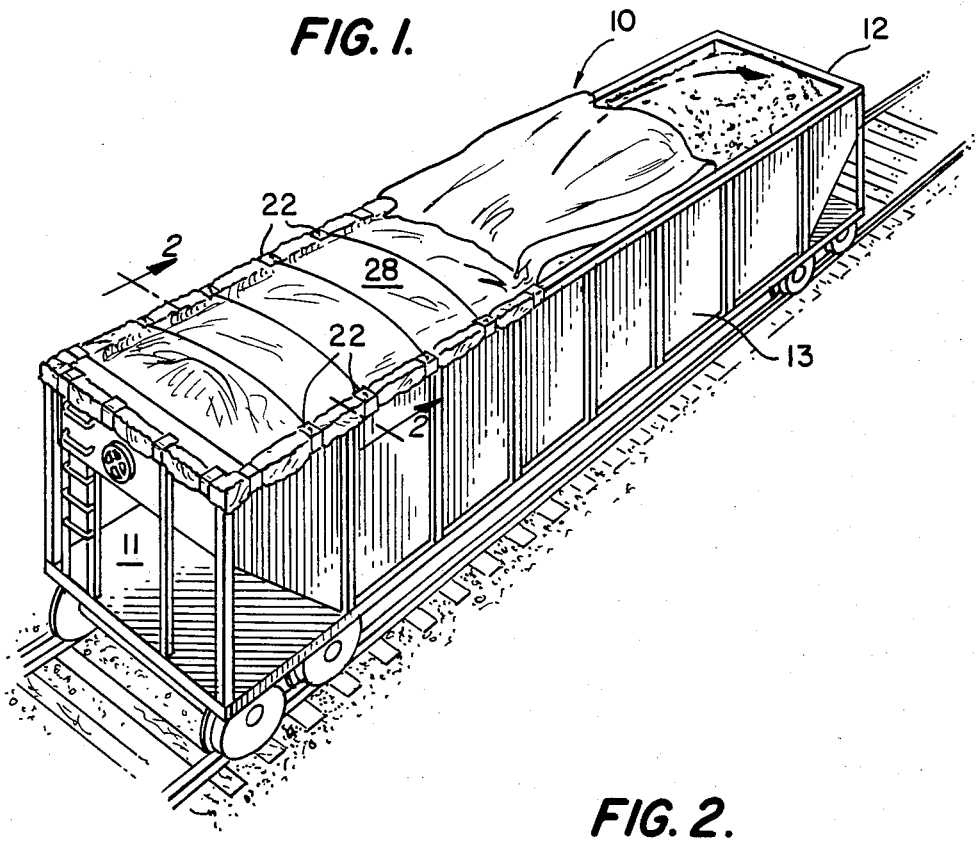
FIG. 1 is a perspective view of an open top railway freight car with the cover of the present invention partially applied thereto.

Referring now to the drawings wherein like reference numerals are employed to designate like parts throughout the several views, 10 designates a coal carrying car of conventional construction, the same constructed of metal and includes front end wall 11 and rear wall 12 and side walls 13 and 14. The coal carrying car may be a flat-bottom car and of standard width. However, coal carrying cars may vary in length from about 34 feet in length to 46 feet in length. Thus, the car cover which we have devised and which can be employed for covering the cargo in the car and secured thereto by suitable clamping means, is capable of being applied to coal cars of varying length. It must be understood that the cover may be employed for covering the cargo in a gondola type car wherein the coal is unloaded by outlets formed in the floor of the car.

There are generally two slightly different forms in the front and rear walls of the coal car. In one form of the car, the front and rear walls are provided with a slightly different construction such as shown in FIGS. 7 to 10 inclusive of the drawings, whereas in the other form of the car, the front and rear walls are formed such as shown in FIG. 5 of the drawings.

Figure 7:
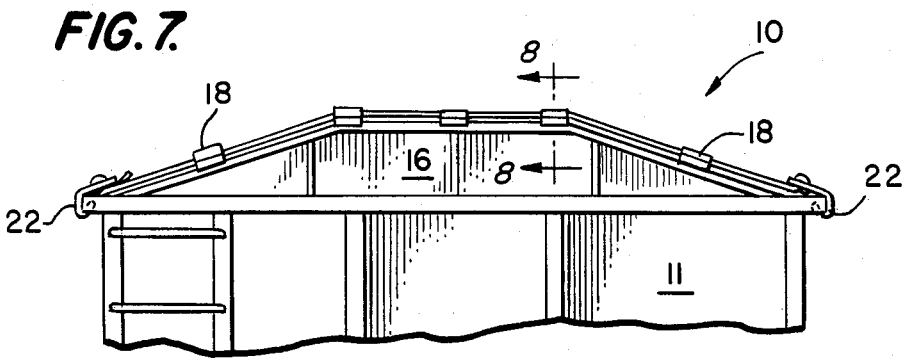
FIG. 7 is a front elevation fragmentary view of one end of a coal car.
Figure 8:
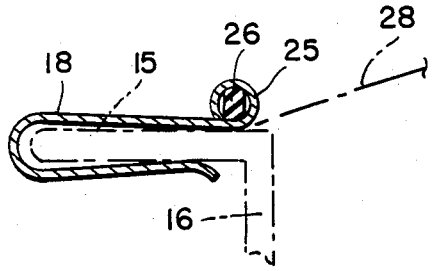
FIG. 8 is a view taken on lines 8—8 of FIG. 7, looking in the direction of the arrows.
Figure 9:
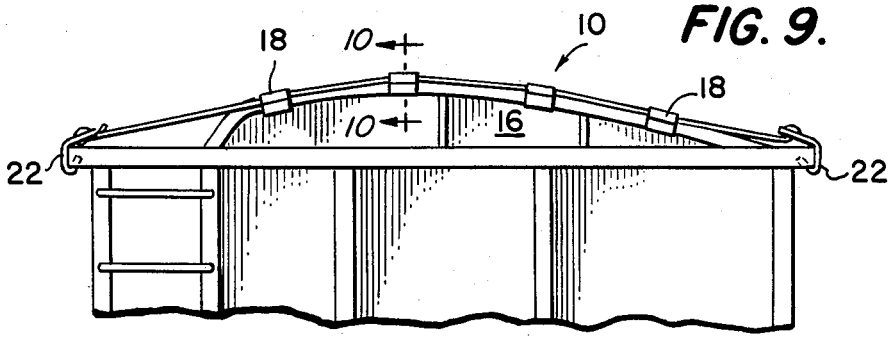
FIG. 9 is a front elevation fragmentary view of one end of a coal car having a slightly different configuration.

Referring now to FIGS. 7 and 8 of the drawings, there is shown an L-shaped flange 15 which is integrally formed with or otherwise secured as by welding or the like to the upper portion 16 which forms a continuation of the front wall 11. While the description of the invention will refer only to the front wall and the continuation of the wall to which the L-shaped flange is mounted, it will be understood that a similar construction will be employed in the formation of the rear wall of the car. A slightly different structure is shown particularly in FIG. 10 of the drawings.

Figure 10:
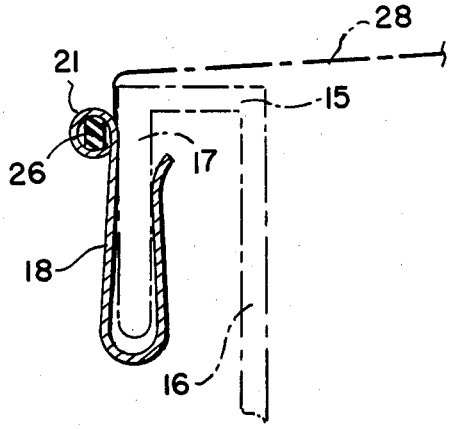
FIG. 10 is a view taken on lines 10—10 of FIG. 9, looking in the direction of the arrows.

In the structure shown in FIG. 10 of the drawings, a vertically and downwardly disposed extension 17 is formed integral with or otherwise secured as by welding or the like to the L-shaped flange 15 provided at the upper portion of the wall 16, and a similar construction is provided for the rear wall of the car. In both of the aforesaid constructions, a resilient clip-like element 18 is adapted to be force-fitted on to the said L-shaped flange 15 such as shown in FIG. 8 of the drawings or to the vertically disposed extension 17 shown in FIG. 10 of the drawings.

Figure 5:
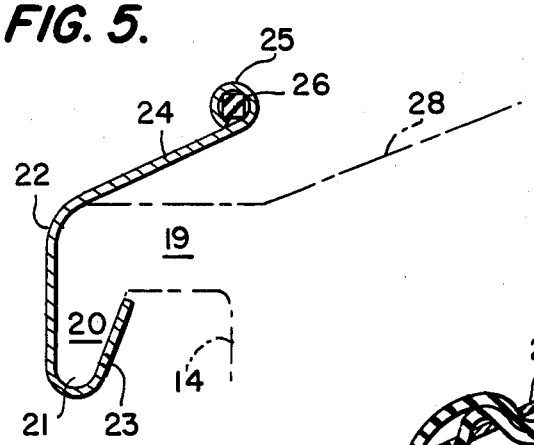
FIG. 5 is a section taken on lines 5—5 of FIG. 4 looking in the direction of the arrows.
Figure 6:
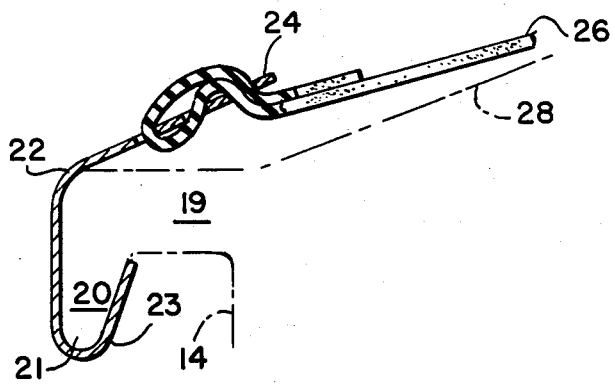
FIG. 6 is a section taken on lines 6—6 of FIG. 4 looking in the direction of the arrows.

Referring now to FIG. 5 of the drawings wherein is disclosed a slightly different structure for the front and rear walls of the cars. As shown in this embodiment of the invention, there is formed at the upper portion of the walls 11, 12, 13 and 14, a horizontally extending member 19 which terminates in a downwardly extending member 20 which is spaced from the front and rear walls and terminates in a rounded area 21. It should be pointed out that the structure shown in FIG. 5 is likewise provided along the upper edges of side walls 13, 14 of the coal car with a horizontally extending member 19 as well as the downwardly extending member 20 having a rounded portion 21. This structure extends throughout the length of the car body and is employed to serve as an anchor means for a clamp 22. The clamp 22 which is mounted at the front, rear and side walls of the car comprises a generally U-shaped lower portion 23 which terminates at the open end of the U-shaped lower portion with a slanted portion 24 and in one instance the slanted portion 24 is provided with a rolled-over edge portion 25 which produces an opening through which a fastener means 26 extends whereas the clamps 22 which are adapted to engage the sides 13, 14 of the car are provided with a plurality of openings 27 through which are threaded fastener means 26. Fastener means 26 may be in the nature of elastic cords of circular or flat formation and are adapted to function in a manner to be described more fully hereinafter. The clamps and clips are spaced along the front, rear and side walls as shown in FIG. 1 of the drawings.

The clamps 22 and clips 18 may be constructed of sheet metal or plastic and are sufficiently pliable so as to enable the same to be applied to the front and rear walls as well as to the sides of the car.

Figure 4:
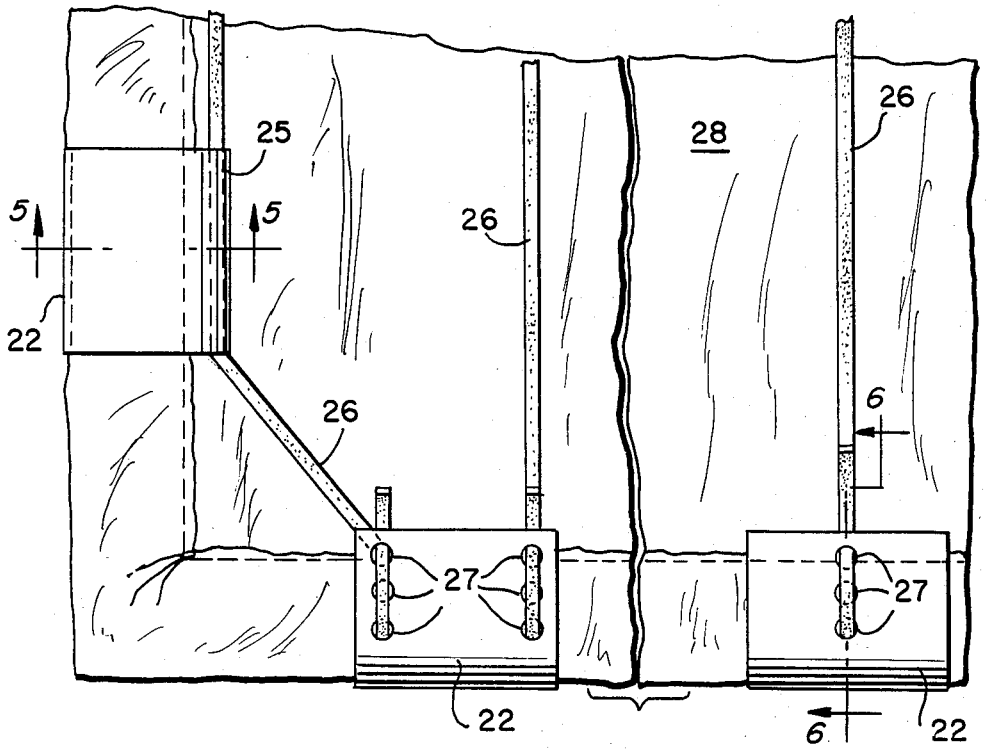
FIG. 4 is an enlarged sectional view taken at the corner of the front end of the car shown in FIG. 1 of the drawings.

Referring now more particularly to FIG. 4 of the drawings which depicts a portion of a corner of the car it will be noted that the clamp 22 shown therein is provided with two sets of openings 27 and the purpose for the multiple sets of openings will be described more fully hereinafter.

The cover 28 which is adapted to be draped over the coal within the car body is preferably a sheet of plastic material of suitable length, width and thickness to extend over the open topped car body and to drape over the ends and sides of the car. Plastic sheething is preferred since the same may be replaced for little cost in the event the sheet should damage when in use or not returned to the shipper following the arrival of the car at it's destination.

To apply the plastic cover to the coal car, a plastic sheet of a dimension sufficient to drape over the open topped coal car is placed over the car with the ends and sides of the sheet extending over the flanges provided at the front, rear and at the sides of the car and with the sheet so placed, the clip 18 such as shown in FIGS. 8 or 10 of the drawings, is force-fitted over the flange 15 of FIG. 8 or to the downwardly extending member 17 of FIG. 10, with the edges of the plastic sheet extending therebetween. As stated previously, the clip is resilient and adapts to the surface area to which it is applied.

Following the attachment of the sheet end to one end of the coal car in the manner aforesaid, the clamps 22 extending along the sides of the car are then caused to engage the downwardly extending member 20. Fasteners in the nature of rubber bands or cords 26 will have been previously loosely threaded through the openings 27 in the clamp and following application of the clamp in the manner aforesaid, the rubber bands or cords are tightened, thus bringing the bands or cords and cover in intimate contact with the coal in the car. To apply a pulling force on the clip or clamp employed for securing the plastic sheet to the ends of the car, the clamp next adjacent the corner of the car is provided with two sets of openings 27, one set of openings adapted to have applied thereto the rubber band or cord which is employed for securing the band or cord extending across the width of the coal car whereas the other set of openings 27 has threaded therein a like fastener which extends therefrom at an angle and is then engaged by the openings formed in the rounded portion 21 of the clip or clamp. Thus, it will be seen that a pulling force will be applied to the clip or clamp employed for securing the plastic sheet to the ends of the car. This will provide a means for preventing accidental removal of the clip or clamp from its mounting at the ends of the car.

Following the attachment of the cover to the front of the car, the side clamps 22 are then successively applied to the sides of the car with the rubber bands or cords loosely threaded in the aforesaid openings in the clamps and following application of the clamps as aforesaid, the rubber bands or cords are tightened thus bringing the cover in close contact with the coal in the car.

Figure 2:
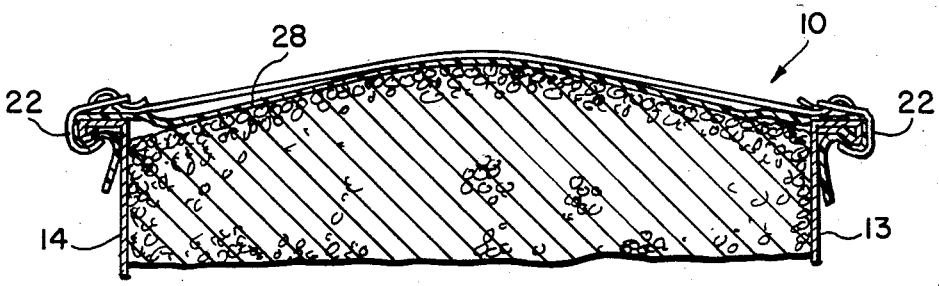
FIG. 2 is a section taken on lines 2—2 of FIG. 1 looking in the direction of the arrows.
Figure 3:
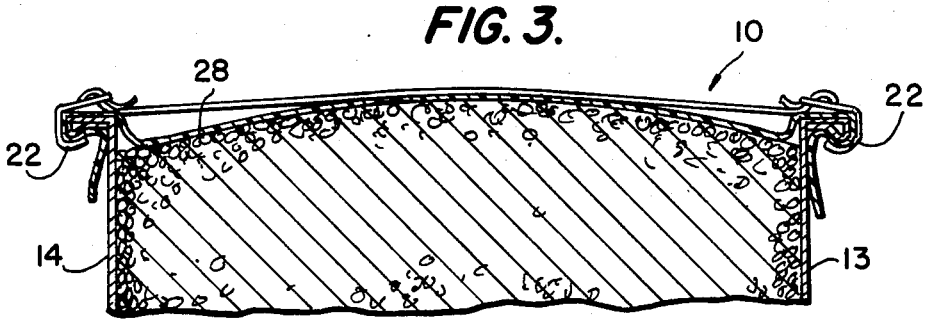
FIG. 3 is a sectional view partly in elevation of the cover showing the manner in which the cover contacts the materials in the car.

Referring now to FIGS. 2 and 3 of the drawings, FIG. 2 shows the manner in which coal assumes a high spot at approximately the center of the width of the car but as the coal will tend to assume a level position during transit due to the tamping of the coal, the rubber bands or cords will tend to follow the level of the coal, thus insuring an intimate contact of the cover with the coal.

Thus, the structure of the cover, along with the means for securing the same to a coal-carrying car, provides for an effective means of preventing coal dust to be scattered into the surrounding atmosphere due to wind forces or by reason of fast moving coal cars during transport. Also, the coal is protected from the elements such as rain or snow, thus resulting in a more efficient combustion of the coal when the same is fed to a suitable furnace. Since the cover is preferably constructed of a suitable plastic sheeting, the same is very inexpensive to replace should the cover be damaged in any manner either before or after the same has been applied to a coal carrying car.

While the car has been described as one employed in the transport of coal, it is obvious that such a cover may be equally employed to cover fine granular materials such as grains or the like.

The foregoing will, it is believed, suffice to impart a clear understanding of our invention without further explanation.

Obviously, the invention as described is susceptible of modifications without departing from the inventive concept and right is hereby made to such modifications as fall within the scope of the appended claims.

We claim:

1. A pre-assembled hold-down combination of clamp and strap means adapted for retaining a flexible cover on a top-flanged, open-top, railway freight car or the like container body, wherein the flange is continuous and outwardly extending, comprising:

A. a first clip or hook type clamp element adapted to securely fit onto an end section of said flange of a first wall of the container body;

B. an opposed clip or hook type second clamp element adapted to securely fit onto an opposed end section of said flange of a second wall of the container body;

C. said clamp elements each having a top wall portion that is in generally opposed and planar relationship to the other;

D. each said top wall portion having at least a first row of three longitudinally spaced, peripherally closed slots extending therethrough and the rows of slots being in alignment;

E. at least one hook or clip type third clamp element adapted to securely fit onto a third flange section that is on a third wall of said container body and that is intermediate of and more closely associated with aforesaid flange end sections;

F. said third clamp element having a top wall portion that is (1) in generally planar relationship to aforesaid top wall portions, (2) extending in direction inwardly of said third flange section, and (3) formed at its free edge in a rolled-over, tubular configuration; and G. strap means (1) threaded and slidable through the tubular formation and (2) at each end adjustably threaded and overlappingly reversely threaded through a respective one of said rows of slots;

H. whereby the assembly of (G) may, as a comprehensive unit, be fitted onto aforesaid flange sections at one end of a flexible sheet-covered said container body and the assembly secured thereon by tightening the strap at said slot means; and I. whereby a second said assembly as in (G) may similarly be fitted to and secured at the other end of a said covered container body to thereby maintain a full covering of the container body.

2. A pre-assembled hold-down combination as in claim 1 wherein:

J. in at least one said assembly as in (G), said first and second top wall portions each have a second row of three longitudinally spaced slots, which second rows are in alignment with each other and generally parallel to and spaced from the first rows of slots; and K. second strap means threaded through the second rows of slots as in (G.2);

L. whereby an intermediate section of the flexible cover is more positively secured to said container body.

3. A hold-down combination as in claim 2 in combination with:

M. at least a further opposed pair of clamp elements as in (A), (B), (C) and (D), but adapted to fit onto and secure on opposed sections of said continuous flange that are located intermediate the fitted and secured assemblies of (G) and (I); and N. third strap means threaded through said further clamp elements as in (K);

O. whereby at least one additional intermediate section of the flexible cover is more positively secured to the container body.

4. A pre-assembled hold-down means as in claim 1 wherein each clamp element comprises a resilient, spring type of clip.

* * * * *